US005918542A

United States Patent [19]

Ruprecht

[11] Patent Number: 5,918,542

[45] Date of Patent: Jul. 6, 1999

[54] DEVICE FOR PERFORATING DIE-CUTTING, CREASING OR FOR ENVELOPE PRINTING OR SPOT VARNISHING WITH PRINTING MACHINES

[75] Inventor: Daniel Ruprecht, Hindelbank, Switzerland

[73] Assignee: Hans E. Ruprecht Holding AG, Krauchthal, Switzerland

[21] Appl. No.: 08/956,471

[22] Filed: Oct. 23, 1997

[30] Foreign Application Priority Data

Oct. 28, 1996 [EP] European Pat. Off. ..... 96810715

[51] Int. Cl.[6] ..... B41F 13/56

[52] U.S. Cl. ..... 101/226; 101/483; 428/909; 118/37; 118/46; 118/269; 156/63; 427/356; 76/107.8; 493/325; 493/370

[58] Field of Search ..... 101/181, 219, 101/226, 224, 225, 227, 248, 375, 382.1, 401, 1, 415.1, 242; 428/909; 118/37, 46, 269; 156/63; 427/356; 76/107.8; 493/324, 325, 370

[56] References Cited

U.S. PATENT DOCUMENTS

| | | | |
|---|---|---|---|
| 1,618,191 | 2/1927 | Hemberger . | |
| 3,616,178 | 10/1971 | Guaynabo et al. | 101/401.1 |
| 3,884,132 | 5/1975 | Snodgrass | 76/107.08 |
| 3,926,118 | 12/1975 | Preuss | 101/415.1 |
| 4,178,402 | 12/1979 | Klapproth | 101/401.1 |
| 4,219,595 | 8/1980 | Spöning | 101/217 |
| 4,512,256 | 4/1985 | Schriber et al. | 101/219 |
| 4,596,546 | 6/1986 | Schellenberg | 493/324 |
| 4,598,641 | 7/1986 | Fischer | 101/409 |
| 4,683,822 | 8/1987 | Sardella et al. | 101/382.1 |
| 4,766,811 | 8/1988 | Linska | 101/415.1 |
| 4,796,529 | 1/1989 | Mathes | 101/230 |
| 5,094,164 | 3/1992 | Kowalczyk et al. | 101/401.1 |
| 5,413,043 | 5/1995 | Fuhrmann et al. | 101/382.1 |
| 5,623,874 | 4/1997 | Ruprecht | 101/226 |
| 5,651,316 | 7/1997 | DeMoore et al. | 101/424.1 |
| 5,715,750 | 2/1998 | Goovaard | 101/382.1 |

FOREIGN PATENT DOCUMENTS

| | | |
|---|---|---|
| 0 739 731 | 10/1996 | European Pat. Off. . |
| 844 397 | 7/1949 | Germany . |
| 1 157 245 | 11/1963 | Germany . |
| 2055897 | 5/1972 | Germany . |
| 2 103 711 | 8/1972 | Germany . |
| 23 41 326 | 3/1975 | Germany . |
| 3801429 | 8/1989 | Germany . |
| 3919281 | 1/1991 | Germany . |
| 41 38 278 | 5/1993 | Germany . |
| 42 15726 | 9/1993 | Germany . |
| 44 35 307 | 4/1996 | Germany . |
| 655 903 | 5/1986 | Switzerland . |
| 267 239 | 3/1927 | United Kingdom . |

OTHER PUBLICATIONS

Drucker, "A New Inline Finishing System" (1996).

*Primary Examiner*—Eugene Eickholt
*Attorney, Agent, or Firm*—Foley & Lardner

[57] ABSTRACT

A device for perforating, die-cutting, cutting or creasing in printing machines comprises a supporting foil which at two of its opposite sides is provided with strips for mounting onto a rubber blanket cylinder of a printing unit, whereby a component for perforating, die-cutting, cutting or creasing is affixed to the supporting foil. An impression cylinder covered with a protection foil co-operates with the rubber blanket cylinder. The use of a relatively hard supporting foil instead of a rubber blanket allows for much cleaner and quicker perforation and punching, and the affixing of the perforating, die-cutting, cutting or creasing component to the supporting foil on the rubber blanket cylinder allows a much easier and more precise positioning of that component. As a result, the device can also be used in endless printing machines. Moreover, the use of an independent inner underlying blanket allows an exact calibration of the total thickness of the supporting foil comprising the working tools. The device can also be used for envelope printing or spot varnishing.

14 Claims, 3 Drawing Sheets

DEVICE FOR PERFORATING DIE-CUTTING, CREASING OR FOR ENVELOPE PRINTING OR SPOT VARNISHING WITH PRINTING MACHINES

BACKGROUND OF THE INVENTION

The present invention relates to a device for perforating, die-cutting, cutting or creasing at printing machines, comprising a supporting foil provided with strips at two opposite edges to be affixed to the fixing means of a rubber blanket cylinder of a printing unit or to the forme cylinder of a coating unit. The invention relates also to the use of the inventive device for envelope printing or spot varnishing.

A counter-pressure device for effectuating perforations and/or punching at offset sheet printing machines is known from the U.S. Pat. No. 5,623,874 of the same applicant. In that known device it is particularly provided for to replace the rubber blanket by a hard foil which can be mounted by a fixing means to the rubber blanket cylinder of a printing unit or to the forme roller of a coating unit. The use of a hard foil instead of the rubber blanket resulted in a significant improvement with respect to the then known state of the art, particularly by allowing very precise punching and perforating and an increase in the passing rates in perforating. It has, however, proved that the use of such known device is not recommended in endless printing machines.

In the meantime, further investigations have also shown that it would be desirable to enlarge the use of hard foils instead of rubber blankets to other areas than that indicated in said prior art publication, e.g. the sole offset sheet printing machines and to facilitate and render more accurate the mounting of perforating and punching tools.

From the German Publication No. 4,138,278 means for punching, creasing and perforating with offset sheet printing machines is known in which a coating unit can either be used for coating or for punching, creasing or perforating. In that device the circumference of the coating forme roller is equipped with a punching sheet steel and the circumference of the printing cylinder with a counter-punching sheet steel or vice-versa, in such a way that the coating forme roller is equipped with a counter-punching sheet steel and the printing cylinder with one or several punching sheets steel. In that prior art document said device is on one side limited to the use in a coating unit and on the other side neither the punching sheet steel nor the counter-punching sheet steel are described more in detail.

Further, from the German Patent No. 2,341,326 a multicolour offset sheet printing machine is known with means for perforating, in which patent it is noticed that for easier access of the perforation rules they are not to be mounted on the counter-punching cylinder but on the rubber blanket cylinder. They are, however, glued onto the elastic rubber blanket of the rubber blanket cylinder. The use of the interposed elastic rubber blanket may well eliminate certain deficiencies of the perforation rules. It prevents however to achieve precise perforations and slows down considerably the passing rate.

Starting from this prior art it is an object of the present invention to provide for a device for perforating, die-cutting, cutting and creasing which means can be used in offset sheet printing machines as well as in endless printing machines and which means allows a clean and fast operation and can easily and precisely be positioned. It is a further object of the invention to provide for easier and faster envelope printing and spot varnishing.

SUMMARY OF THE INVENTION

Such a device is defined in independent claim 1, wherein the means for perforating, die-cutting, cutting or creasing is affixed to the supporting foil mounted on the rubber blanket cylinder of a printing unit or to the forme cylinder of a coating unit, the impression cylinders co-operating with said cylinders respectively being protected by a protection foil. The device for envelope printing or varnishing comprises a supporting foil mounted on the rubber blanket cylinder and having affixed on its top foil of sheet metal a rubber blanket pad corresponding to the field the envelope is to be printed or the field to be varnished. Further advantages and embodiments are defined in the dependent claims.

In the following embodiments of the invention will be described with reference to the drawing.

DETAILED DESCRIPTION OF THE INVENTION

Figure 1:
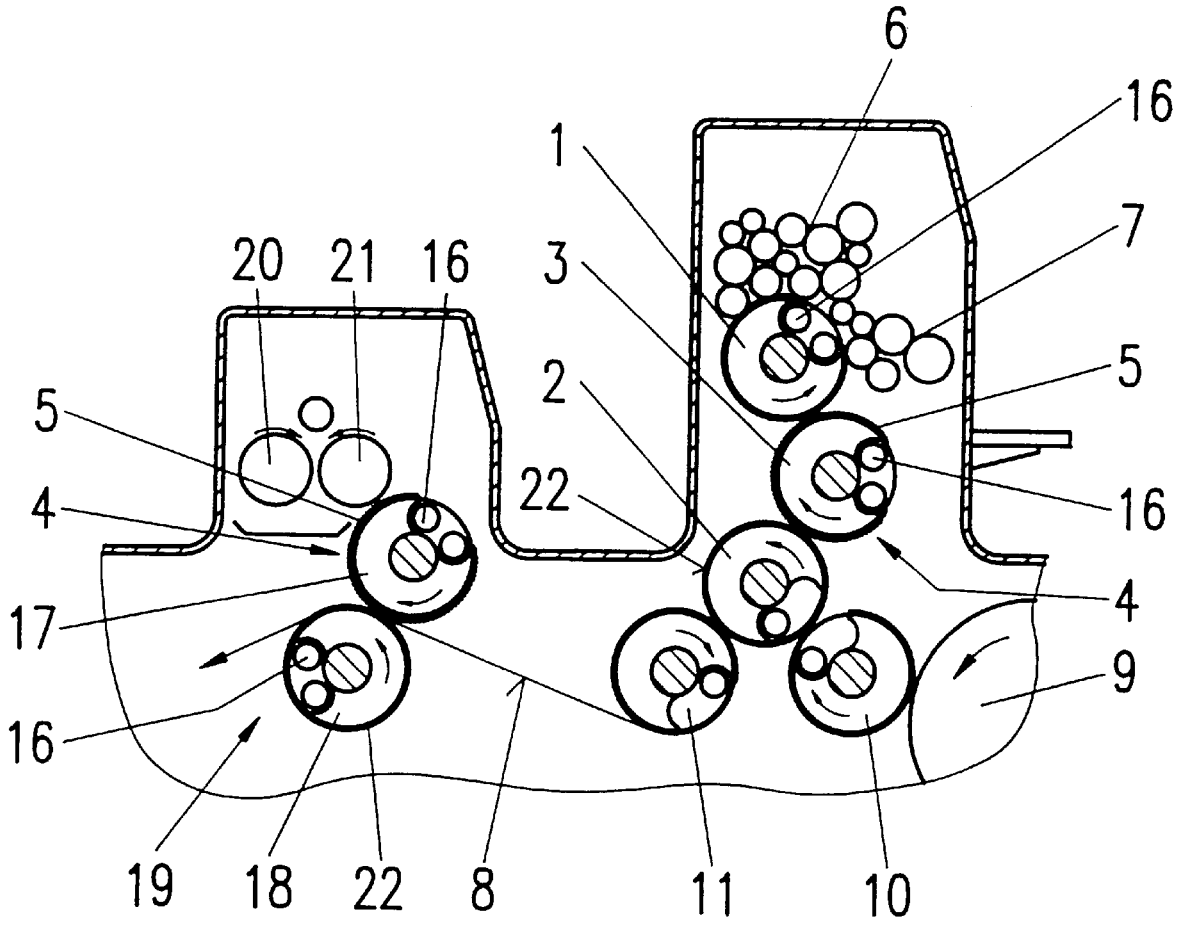
FIG. 1 shows schematically a printing and coating unit of an offset sheet printing machine.

FIG. 1 schematically shows one of optionally several printing units in a offset sheet printing machine with a plate cylinder 1, an impression cylinder 2 and a rubber blanket cylinder 3 disposed in-between, on which a supporting foil 4 is mounted instead of a rubber blanket. If the printing unit is used for printing, however, a conventional rubber blanket is mounted on said rubber blanket cylinder 3. For ease of illustration, both, the rubber blanket cylinder 3 and the impression cylinder 2 are shown with equal diameters. The means according to the present invention can, however, also be used in printing or coating units presenting impression cylinders whose diameters are twice the diameters of the rubber blanket cylinder and the forme cylinder respectively.

In contrast to what is described in the European Patent Application No. 0,739,731 for perforating, the perforation rule 5 is mounted on the supporting foil 4 which itself is affixed to the rubber blanket cylinder 3, usually by a two side adhesive tape, whereby the teeth of the perforation rule 5 are directed towards the impression cylinder 2 in order to perforate the paper running in-between these two cylinders. For die-cutting, cutting or creasing adequate means, e.g. die-cutting forms, cutting forms or creasing rules respectively, are mounted. Herein below only a perforation rule will be mentioned, however it is to be understood that this includes all possible means for perforating, die-cutting, cutting and creasing. Moreover, it is to be understood that in place of one single perforation rule there may be used several ones.

By affixing the perforation rule 5 onto the supporting foil 4 on the rubber blanket cylinder 3 it is achieved, on one side, that due to the fact that the perforation rule 5 can easily be accessed, it can be positioned more precisely on the impression cylinder 2, and on the other side, especially, that the same unit can be used on endless printing machines, which is not the case with the unit as described in U.S. Pat. No. 5,623,874.

The impression cylinder 2 would be sufficient as a back-pressure means. However, it is recommendable to protect its surface by a protection foil 22 made of metal or synthetic material. Said protection foil 22 can be affixed by means of a two side adhesive tape. This combination results in a better and more precise perforation or punching of the paper and furthermore allows to maintain the normal printing speed of offset sheet printing or endless printing machines, such that printing, and perforating, die-cutting, cutting or creasing can be effectuated at the same speed.

In FIG. 1 one recognises also an inking system 6 with different inking rollers which transfer the printing ink onto the plate cylinder 1, and a damping system 7. The paper sheet 8 arrives from the intermediate drum 9 to a first feed drum 10, from where it continues towards the impression cylinder 2 and further towards the second feed drum 11, from where the paper sheet 8 may be transferred to a further drum, and if provided for, to a further inking system or a coating unit 19. Correspondingly, but without the coating unit, this is also true for an endless printing machine.

Figure 2:
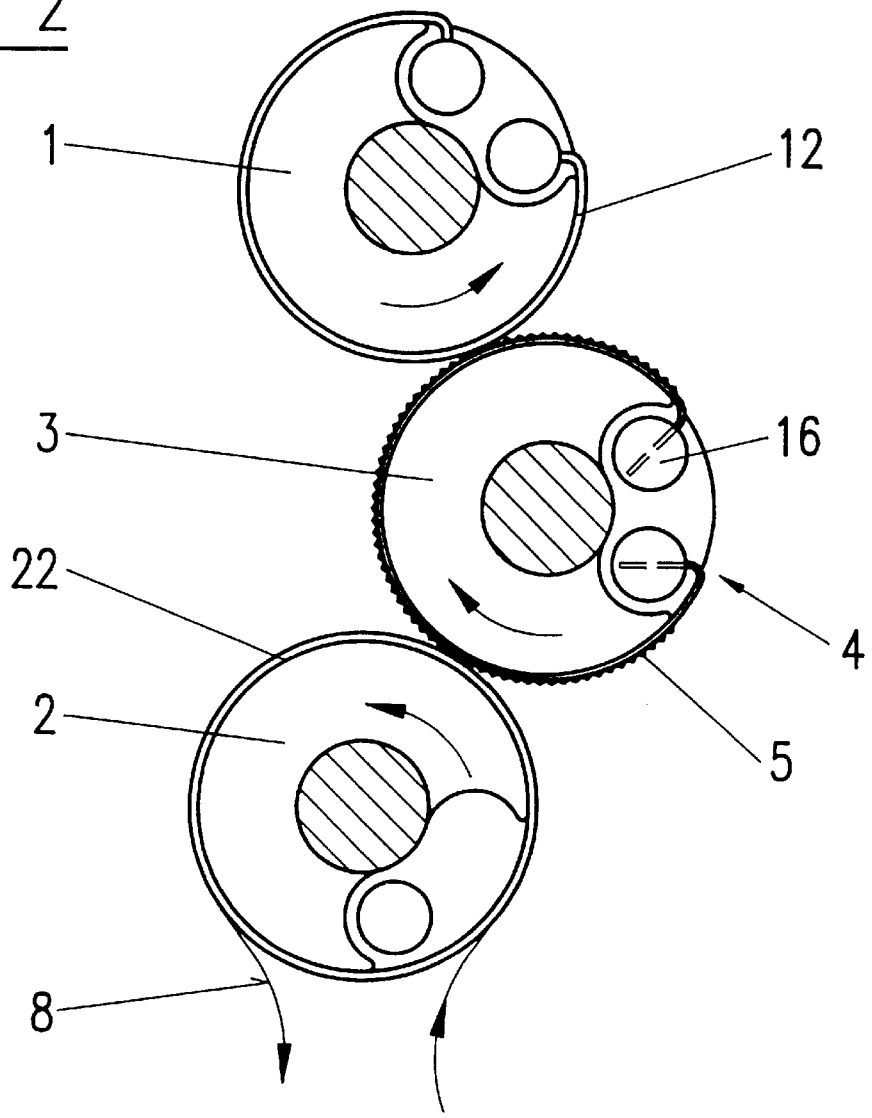
FIG. 2 shows a detail of FIG. 1 on a greater scale.

In FIG. 2 the plate cylinder 1, the impression cylinder 2 and the rubber blanket cylinder 3 are represented on a larger scale and in a sectional view. The plate cylinder 1 with the printing plate affixed to it is well known in the state of the art and differs in its constructive details from one type of printing machine to another. In the embodiment here described the impression cylinder 2 is equipped with a protection foil 22, to protect its surface. On the rubber blanket cylinder 3 is mounted the supporting foil 4 onto which a perforation rule 5 is affixed, if perforating is to be effectuated. The perforation rule 5 may be fixed lengthwise or crosswise.

Although the most important advantages of the means according to the present invention are achieved in printing units, it can also advantageously be used in coating units. If a coating unit 19 is to be used for perforating, die-cutting, cutting or creasing, on one of its cylinders, the forme cylinder 17, the supporting foil 4 is mounted onto which the perforation rule or forme 5 is affixed. On the other cylinder, impression cylinder 18, the protection foil 22 is mounted. Both cylinders 17 and 18 are provided with similar fixing means 16 for the parts to be mounted onto them, including rails and strips 13, as the afore mentioned cylinders. On the coating module 19 are further illustrated a metering roller 20 and a coating forme roller 21, which of course are not in contact with the forme cylinder 17 during perforating, punching and creasing. Underneath the coating forme roller 21 a coat reception basin is traced.

If no perforating or punching is to be effectuated, a conventional rubber blanket is mounted on the rubber blanket cylinder 3 and the perforation rule or form 5 is taken off. The thickness of the layer(s) mounted on the rubber blanket cylinder 3 are standardised in such a way that a defined distance between the rubber blanket cylinder 3 and the impression cylinder 2 co-operating with same is achieved. The supporting foil 4 has to have the same thickness as the rubber blanket, whereby the thickness of the perforation rule or forme or the sheet metal are to be taken in account. The same applies equally for the coating module 19.

Since such a thick supporting foil 4 made of sheet metal or synthetic material is not necessary and could be fastened on the cylinder only with difficulties, a thin metal foil having a thickness of 0.3 mm for example is used. In order to achieve the—for European countries—standard thickness of 1.95 mm, an underlying blanket 15 of 1.65 mm thickness is spread under the foil. This underlying blanket 15 may have a variable stiffness, adapted to the intended use, and e.g. be made from one or several press board plates. It may be fastened on one side only or on both sides, or even be affixed to the foil.

Figure 3A:
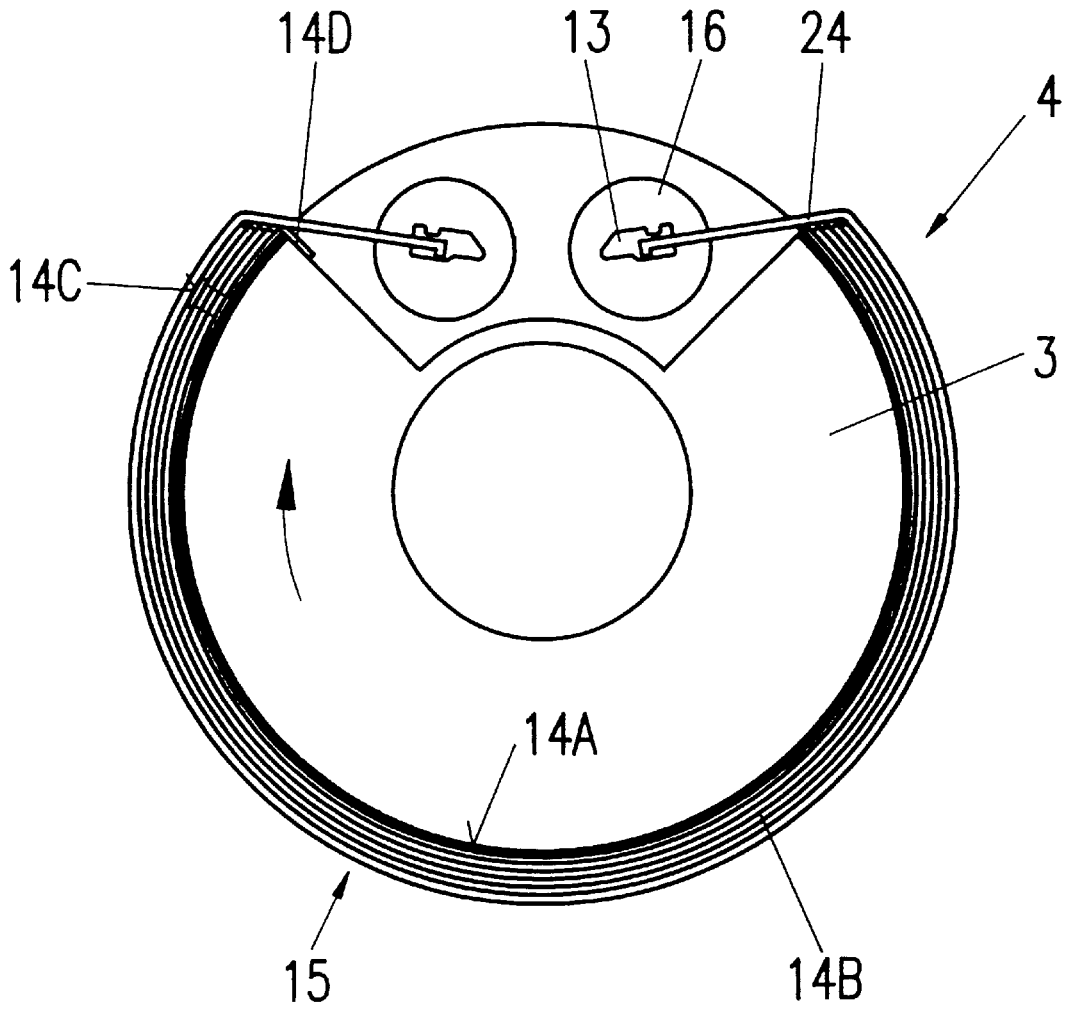
FIG. 3A shows a sectional view of the rubber blanket cylinder of FIG. 2 on a greater scale.

In a preferred embodiment according to FIG. 3A the inner underlying blanket 15 of the supporting foil 4 is an independent unit, formed, seen from the side of the rubber blanket cylinder 3, of a combination of at least one calibrated cardboard sheet 14A, having a thickness of between 0.30 to 0.40 mm, and thin aluminium sheets 14B of e.g. 0.30 mm thickness. This unit is at least at one of its sides fastened together by rivets 14C. The first aluminium sheet, seen from the side of the cardboard sheet, is provided with an edge 14D hooked into the front side of the cylinder gap of the rubber blanket cylinder 3, to position the underlying blanket 15. By this combination, the total thickness of the layers on the rubber blanket cylinder 3 can easily be adjusted to the needs of different types of printing machines, thus avoiding that the printer uses a wrong total thickness. The underlying blanket 15 is simply hooked into the front edge of the cylinder gap and the foil 24 fixed with strips onto the fixing means.

Figure 3B:
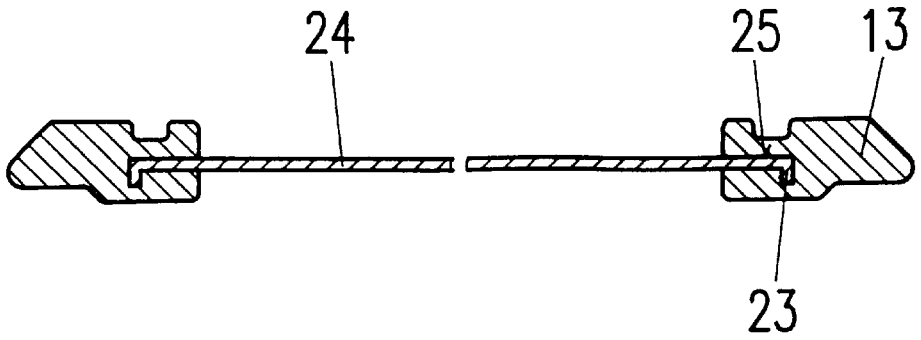
FIG. 3B shows a sectional view of a foil affixed by strips.

According to FIG. 3B top foil 24 is affixed to two opposite strips 13, which are glued or riveted to it. To increase the tear out resistance the supporting foil 4 is provided with edges 23 on both of its ends, which edges penetrate into corresponding grooves 25 at the strips 13. The foil 24 may be made of a metal sheet, e.g. chromium steel or any other suitable metal or from synthetic material.

In order to protect the surface of the foil it may be convenient to mount on its top side a relatively hard cover foil, for example of synthetic material, which can be replaced by a new one if necessary. Of course, the total thickness of the supporting foil must correspond to the thickness of the conventional rubber blanket used in a corresponding application.

The strips 13 correspond to those used with the rubber blanket, thus making it possible to use the same or a similar fixing means 16 on the rubber blanket cylinder 3. Thus, in using the supporting foil for perforating, together, if necessary, with the underlying blanket and/or the cover foil, no modification of the printing or coating unit is necessary, compared to the use with an usual rubber blanket.

It should furthermore be noted that, besides the advantages already mentioned, a further advantage in using the foil 4 is that the paper sheets are not deformed during perforating or punching. Therefore, the entire stack can be piled up in the same manner as before the perforation or punching. Its transportation is thus considerably facilitated, in contrast to the strongly deformed sheets after perforating with a rubber blanket. Therefore, it is also possible to use foil 4 for punching of different patterns, e.g. address areas or the like.

Figure 4:
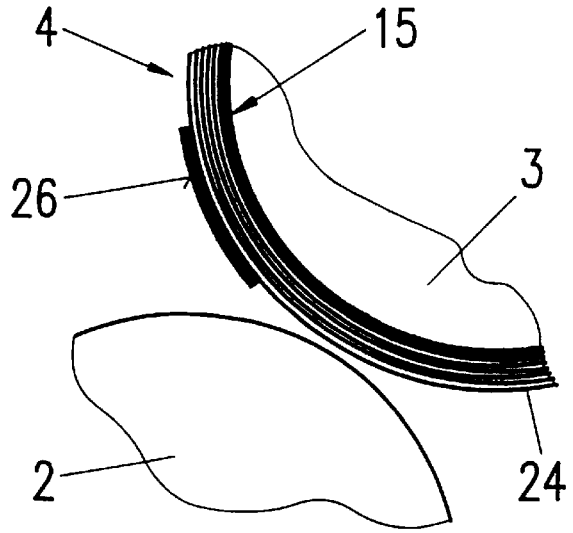
FIG. 4 shows in a sectional view the use of the inventive means for envelope printing.

FIG. 4 discloses a further advantageous use of the supporting foil, the use of it for printing envelopes. Envelopes have one or two flaps as closure means causing uneven parts, causing folds and the like. The same applies to windows in the envelopes. All these elements cause difficulties for the printing of the envelopes. The arrangement of FIG. 4 enables a smooth and good quality printing of envelopes. FIG. 4 shows the impression cylinder 2 and the rubber blanket cylinder 3, on which the supporting foil 4 comprising top foil 24 is fastened as in the previous embodiments. Preferably, top foil 24 is a sheet metal foil. On top foil 24 a blanket pad 26 is fastened, the pad having a self-adhesive layer for good adherence. It is evident that the rubber blanket pad 26 has only the size of the field to be printed, is inked like a usual rubber blanket for printing, and is fastened on the supporting foil at the spot corresponding to the field where the envelope is to be printed. The alignment of the pad is assisted by a coordinate paper fixed on the top foil 24.

The use of the inventive set of supporting foil 4 comprising foil 24 enables to print only at the field foreseen for it and avoids the use of a rubber blanket covering the whole rubber blanket cylinder and thus also the folds and unevennesses of an envelope. It is evident that the total thickness of the supporting foil 4 with top foil 24 and pad 26 must be the same as the conventionally used rubber blanket. This is effectuated, as described above, by reducing the thickness of the supporting foil set, e.g. of inner underlying blanket 15.

The same set up with the supporting foil 4 comprising the top foil 24 and one rubber blanket pad or several pads can be used for varnishing at one spot, resp. several spots. To this end, with prior art devices, the spot or spots where the varnish has to be applied has to be projected on the rubber blanket sheet, the rubber blanket is then removed and the space on the rubber blanket where the varnish is not to be applied is subsequently cut out and the rubber blanked with the holes replaced.

With the set up according to the invention the rubber blanket pad or pads with a self-adhesive layer can be cut in the size of the spot to be varnished and, since the top foil 24 has a coordinate paper on its surface, the pad(s) can be simply applied upon, without having to remove and replace the supporting foil. This procedure simplifies significantly the spotwise varnishing. It is also possible to prepare the supporting foil with the pad or pads and simply fasten it if varnishing is to be accomplished.

It is evident that the spot varnishing can be effectuated as well with the printing unit as with the coating unit, in the latter the supporting foil with the varnishing pads being mounted on the forme cylinder. It is appreciated that the envelope printing as well as the varnishing is effectuated without using protection foil 22 on the impression cylinder.

I claim:

1. A printing machine having an arrangement for die-cutting, cutting or creasing paper sheets, comprising:

a printing group having a first impression cylinder and an allocated rubber blanket cylinder, said impression cylinder being protected by a protection foil and co-operating with said rubber blanket cylinder;

a varnishing group having a second impression cylinder and an allocated forme cylinder, said impression cylinder being protected by a protection foil and co-operating with said forme cylinder, one of said rubber blanket cylinder and said forme cylinder being equipped with fixing means for fastening a foil layer thereto;

a supporting foil provided with strips at two opposite edges affixed to said fixing means of one of said rubber blanket cylinder or said forme cylinder, wherein said supporting foil has affixed to it means for perforating, die-cutting, cutting or creasing.

2. A device according to claim 1, wherein said protection foil is made of sheet metal or synthetic material.

3. A device for a printing machine, comprising a supporting foil provided with strips at two opposite edges for affixing to a rubber blanket cylinder or a forme cylinder, wherein said supporting foil has affixed to it means for perforating, die-cutting, cutting or creasing.

4. A device according to claim 3, wherein said supporting foil comprises a top foil on its upper side and an inner underlying blanket on its lower side, directed towards a rubber blanket cylinder, whereby the thickness of said supporting foil corresponds to the thickness of a rubber blanket conventionally used for the given application, both ends of the supporting foil being held in said strips.

5. A device according to claim 4, wherein each of said ends of the supporting foil presents an edge penetrating into a corresponding groove on each strip.

6. A device according to claim 3, wherein said supporting foil is made of metal or of synthetic material.

7. A device according to claim 3, wherein said supporting foil is provided with a detachable top foil on its upper side, whereby the total thickness of the supporting foil including the top foil is, for a given application, equal to the thickness of a conventionally used rubber blanket in said application.

8. A device according to claim 3, wherein said protection foil is made of sheet metal or synthetic material.

9. An inner underlying blanket for a device for perforating, die-cutting, cutting or creasing at printing machines, wherein said inner underlying blanket is formed as a compound of at least one calibrated cardboard sheet and one aluminum sheet, the first underlying cardboard sheet being designed to lie on a cylinder provided for receiving the compound and the first aluminum sheet lying on said cardboard sheet being provided with an edge designed to be hooked into a cylinder gap of said cylinder.

10. A device for envelope printing with a printing machine, said printing machine comprising a printing group having an impression cylinder and an allocated rubber blanket cylinder, the device comprising a supporting foil provided with strips at two opposite edges for affixing to said rubber blanket cylinder, wherein the envelope printing device further comprises a rubber blanket pad which is affixed at the spot corresponding to the field of the envelope to be printed to said supporting foil mounted on the rubber blanket cylinder and co-operating with the impression cylinder.

11. A device for spot varnishing with a printing machine, said printing machine comprising a printing group having an impression cylinder and an allocated rubber blanket cylinder, the device comprising a supporting foil provided with strips at two opposite edges for affixing to said rubber blanket cylinder, wherein the spot varnishing device further comprises one or more rubber blanket pad(s) which is (are) affixed to said supporting foil mounted on the rubber blanket cylinder at the spot(s) corresponding to the field(s) where the varnish is to be applied, said pad(s) co-operating with the impression cylinder.

12. A device for spot varnishing with a printing machine, said printing machine comprising a coating unit having an impression cylinder and an allocated forme cylinder, the device comprising a supporting foil provided with strips at two opposite edges for affixing to said forme cylinder, wherein the spot varnishing device further comprises one or more rubber blanket pad(s) which is (are) affixed to said supporting foil mounted on the forme cylinder at the spot(s) corresponding to the field(s) where the varnish is to be applied, said pad(s) co-operating with the impression cylinder.

13. A device for perforating, die-cutting, cutting or creasing in an offset sheet printing machine or an endless printing machine comprising a plate cylinder, an impression cylinder having a protection foil and a rubber blanket cylinder positioned between said two cylinders and co-operating with said impression cylinder, the rubber blanket cylinder provided with a supporting foil, said supporting foil provided with strips at two opposite edges for affixing to said rubber blanket cylinder, wherein said supporting foil has affixed to it means for perforating, die-cutting, cutting or creasing.

14. A device for perforating, die-cutting, cutting or creasing in a coating unit comprising a forme cylinder and an impression cylinder having a protection foil, the forme cylinder provided with a supporting foil, said supporting foil provided with strips at two opposite edges for affixing to said forme cylinder, wherein said supporting foil has affixed to it means for perforating, die-cutting, cutting or creasing.

* * * * *